US005394842A

United States Patent [19]

Kobayashi

[11] Patent Number: 5,394,842

[45] Date of Patent: Mar. 7, 1995

[54] ROCKER ARM WITH AN OIL GROOVE

[75] Inventor: Tsutomu Kobayashi, Shizuoka, Japan

[73] Assignee: Suzuki Motor Corporation, Shizuoka, Japan

[21] Appl. No.: 268,236

[22] Filed: Jun. 29, 1994

[30] Foreign Application Priority Data

Oct. 30, 1993 [JP] Japan ..... 5-294338

[51] Int. Cl.[6] ..... F01M 9/10

[52] U.S. Cl. ..... 123/90.36; 123/90.39; 74/559

[58] Field of Search ..... 123/90.33, 90.36, 90.39, 123/90.41, 90.44; 74/519, 559

[56] References Cited

U.S. PATENT DOCUMENTS 4,523,551 6/1985 Arai et al. ..... 123/90.36
4,616,607 10/1986 Kodama et al. ..... 123/90.36
4,630,576 12/1986 Raymond ..... 123/90.36
4,644,914 2/1987 Morita et al. ..... 123/90.36

FOREIGN PATENT DOCUMENTS 3-6008 1/1991 Japan .

*Primary Examiner*—E. Rollins Cross
*Assistant Examiner*—Weilun Lo
*Attorney, Agent, or Firm*—Flynn, Thiel, Boutell & Tanis

[57] ABSTRACT

An improved rocker arm which is held in positive engagement with a head thrust surface of a cylinder head to avoid the occurrence of pitching of a valve stem end and vibration or noise from a valve-driving system. The rocker arm enables a rocker shaft spring to be set at a reduced load, whereby low friction is realized. An arm thrust surface of the rocker arm is provided with an oil groove having a predetermined depth. The arm thrust surface is positioned against a head thrust surface of the cylinder head. The oil groove communicates with the rocker shaft hole so as to introduce oil outside.

4 Claims, 4 Drawing Sheets

ROCKER ARM WITH AN OIL GROOVE

FIELD OF THE INVENTION

This invention relates to a rocker arm and, more particularly, to an improved rocker arm which is held in reliable engagement with a head thrust surface of a cylinder head.

BACKGROUND OF THE INVENTION

In engines, a valve-driving mechanism is provided in order to actuate intake and exhaust valves for opening and closing air inlet and outlet ports of a combustion chamber. FIGS. 7 and 8 illustrate such a valve-driving mechanism. In this mechanism, each rocker arm 102 is defined with a-rocker shaft hole 104 through which a rocker shaft 106 is inserted. The rocker arm 102 includes a cam-side abutting portion 108 which is positioned in contact with a cam 112 mounted on a camshaft 110. The rocker shaft 106 has an oil passage 114 formed on a shaft axis C. The rocker shaft 106 is further formed with an oil flow communication aperture 116 which is radially oriented to communicate with the oil passage 114.

The rocker arm 102 further includes a valve-side pressing portion 118 which is provided with a hydraulic adjuster (H. L. A.) 120. The hydraulic adjuster 120 contacts a valve stem end 124 of an air intake and exhaust valve 122.

In addition, to introduce oil into the hydraulic adjuster 120, an adjuster-side oil aperture 126 and an adjuster-side oil passage 128 are formed in the rocker shaft 106 and the rocker arm 102, respectively.

The rocker arm 102 is pivotably supported on the rocker shaft 106. The axial position of the rocker arm 102 is determined by a head thrust surface 132 of a cylinder head 130. The rocker shaft 106 has a spiral spring 134 in engagement therewith, which spring causes the rocker arm 102 to be pressed against the head thrust surface 132. A sliding or bearing portion between the rocker arm 102 and the rocker shaft 106 is subjected to lubrication through the supply of oil thereto from the oil passage 114 and the oil flow communication aperture 116.

When the rocker shaft spring 134 is set at a greater load, friction exerted on the rocker arm 102 in a thrust direction increases. Accordingly, the spring 134 is set at a load which is minimized to a level required to hold the rocker arm 102 in position.

One example of the aforesaid rocker arm is disclosed in, for example, published Japanese Utility Model Application Laid-Open No. 3-6008. In the rocker arm of this publication, a bearing portion is located midway along a swingable arm portion of the rocker arm. The swingable arm portion is provided with a pressing portion at one end and a contact portion at the other end. The pressing portion serves to press a valve stem of a valve body, and is curved in a desired direction. The contact portion contacts a camshaft. The bearing portion is provided with a protruding portion. The protruding portion extends in a stepped manner toward a curvilinear region of the pressing portion so as to provide a maximum protrusion at a lower end region of the bearing portion. Further, the protruding portion includes a staged portion at a lower end, inner peripheral region of the bearing portion.

In a rocker arm as shown in FIGS. 7 and 8, flow of oil, which is supplied through the oil flow communication aperture 116, is directed between the rocker arm 102 and the head thrust surface 132 on the cylinder head 130. The resulting hydraulic pressure causes the rocker arm 102 to be lifted off the head thrust surface 132, and as a result the rocker arm 102 is moved away from the head thrust surface 132. This causes inconveniences in that the stem end 124 of valve 122 and hydraulic adjuster 120 assume out-of-line positions, whereby the valve stem end 124 pitches or an unusual sound is emitted. There is a further inconvenience in that the hydraulic adjuster 120 is disengaged from the valve stem end 124 when the rocker arm 102 is forced to move a large distance.

To obviate the above-described inconveniences, a first aspect of the present invention provides a rocker arm defined with a rocker shaft hole, through which a rocker shaft is inserted, the rocker shaft having an oil passage defined on a shaft axis, the rocker shaft being further formed with an oil flow communication aperture which is radially directed to communicate with the oil passage, the axial position of the rocker arm being determined by a head thrust surface of a cylinder head, comprising the improvement wherein an arm thrust surface of the rocker arm is provided with an oil groove having a predetermined depth, the arm thrust surface being in abutment with the head thrust surface of the cylinder head, the oil groove communicating with the rocker shaft hole so as to introduce oil outside.

A second aspect of the present invention provides a rocker arm defined with a rocker shaft hole, through which a rocker shaft is inserted, the rocker shaft having an oil passage defined on a shaft axis, the rocker shaft being further formed with an oil flow communication aperture which is radially directed to communicate with the oil passage, the axial position of the rocker arm being determined by a head thrust surface of a cylinder head, comprising the improvement wherein an arm thrust surface of the rocker arm is provided with an oil groove having a predetermined depth, the arm thrust surface being in abutment with the head thrust surface of the cylinder head, the oil groove communicating with the rocker shaft hole so as to introduce oil outside, and wherein the arm thrust surface further has a chamfered portion provided around the rocker shaft hole, the chamfered portion being greater in depth than the oil groove.

According to the construction of the present invention, when oil overflows from a location at which a rocker arm is positioned in scraping contact with an oil flow communication aperture and a rocker shaft, the oil is blocked from penetrating between an arm thrust surface of the rocker arm and a head thrust surface of a cylinder head, but is guided into an oil groove so as to be discharged outside. The rocker arm is thereby prevented from being dislodged and isolated from the head thrust surface. This feature can prevent the occurrence of pitching of the valve stem end and vibration or noise from the valve-driving system.

Furthermore, since the rocker arm is held in engagement with the head thrust surface, the rocker shaft spring can be set at a lighter load. As a result, low friction is achievable.

DETAILED DESCRIPTION

Figure 1:
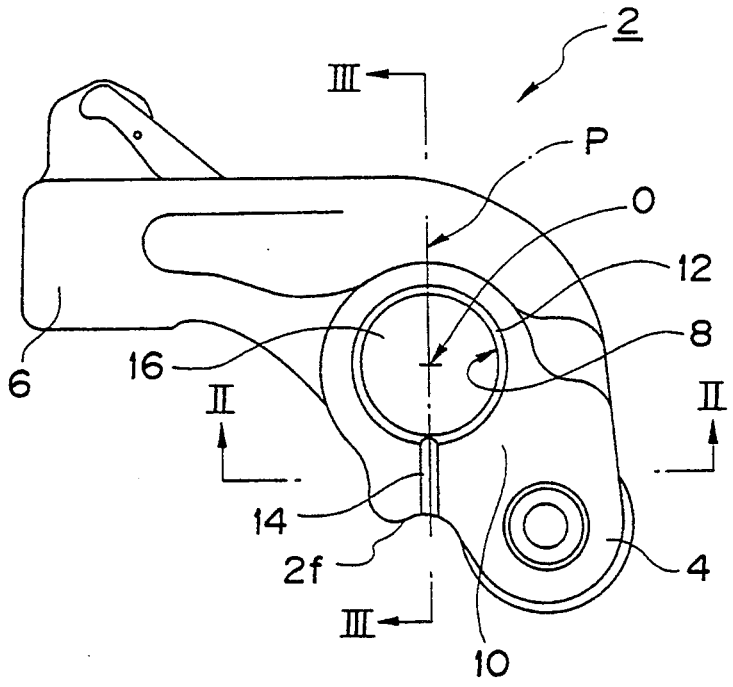
FIG. 1 is a front view illustrating a rocker arm according to a first embodiment of the invention.
Figure 2:
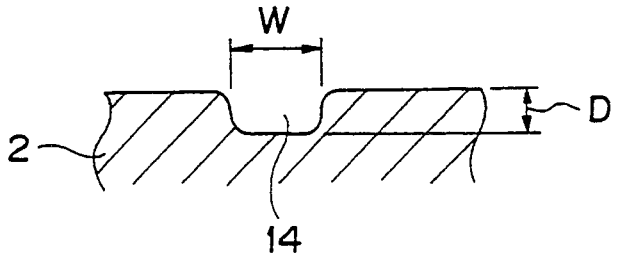
FIG. 2 is a cross-sectional view taken along line 2—2 of FIG. 1.
Figure 3:
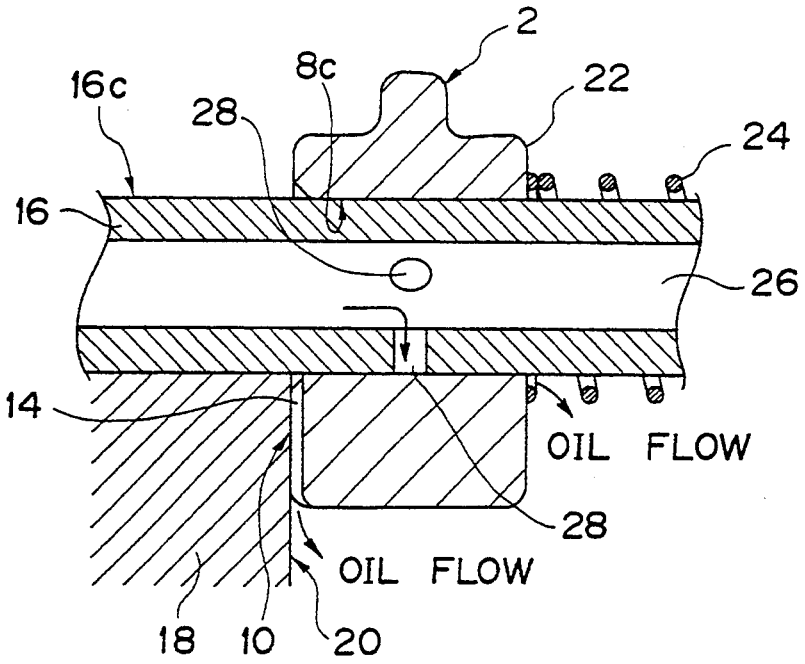
FIG. 3 is a cross-sectional view taken along line 3—3 of FIG. 1.

FIG. 1 through FIG. 3 illustrate an embodiment of the present invention. In FIG. 1, reference numeral 2 denotes a rocker arm of an engine valve-driving mechanism. This rocker arm 2 includes a cam-side abutting portion 4 and a valve-side pressing portion 6. A rocker shaft hole 8 is formed at a central portion of the rocker arm 2.

The rocker arm 2 is defined with a planar arm thrust surface 10 on one side of the periphery of the rocker shaft hole 8. The arm thrust surface 10 has a chamfered portion 12 formed around the rocker shaft hole 8. The chamfered portion 12 has a predetermined depth.

The arm thrust surface 10 is further formed with an oil groove 14. The oil groove 14 communicates with the rocker shaft hole 8, while being open to an outer surface 2*f* of the rocker arm 2. As shown in FIG. 2, the oil groove 14 is configured to have width W and depth D. The oil groove 14 is located on a centerline P which extends through a central point O of the rocker shaft hole 8.

In FIG. 3, the rocker arm 2 is shown mounted on a rocker shaft 16. This is accomplished by the rocker shaft hole 8 being permitted to receive and enclose the rocker shaft 16. At this time, the arm thrust surface 10 of the rocker arm 2 is positioned in contact with a head thrust surface 20 of a cylinder head 18. The other surface 22 on the opposite side of the rocker arm 2 is thrust by a rocker shaft spring 24 which is spirally wound around the rocker shaft 16. The rocker shaft spring 24 presses the rocker arm 2 toward the cylinder head 18 with a predetermined force.

The rocker shaft 16 has an oil passage 26 formed on a shaft axis C. The rocker shaft 16 is further formed with a plurality of radially extending oil flow communication apertures 28 at a location where the rocker arm 2 is situated. The oil flow communication apertures 28 communicate with the oil passage 26 and the outer peripheral surface 2*f*.

The operation of the present embodiment will now be described.

As illustrated in FIG. 3, flow of oil from an oil passage 26 is directed toward both sides of rocker arm 2 through oil flow communication apertures 28 followed by a gap between an outer peripheral surface 16*c* of the rocker shaft 16 and an inner surface 8*c* of the rocker shaft hole 8.

The arm thrust surface 10 of the rocker arm 2 is grooved to form the oil groove 14 on the side of the rocker arm 2 opposite the cylinder head 18. Accordingly, the oil smoothly flows outside through the oil groove 14.

As a result, no oil flows between the head thrust surface 20 and the arm thrust surface 10. Consequently, no hydraulic pressure is created between the surfaces 20 and 10. Axial movement of the rocker arm 2 is thereby eliminated, which otherwise would cause the arm thrust surface 10 to be spaced apart from the head thrust surface 20. Accordingly, pitching of the valve stem end (not shown) and vibration or noise from the valve-driving mechanism can be prevented from occurring.

Furthermore, since the rocker arm 2 is held in position, the rocker shaft spring 24 can be set at a reduced load. Consequently, low friction is attainable.

Moreover, in the event that the rocker arm 2 is formed by an aluminum die casting, molds can be used to form the oil groove 14 and the chamfered portion 12. This feature eliminates additional machining operations, and can be advantageous in view of cost.

Figure 4:
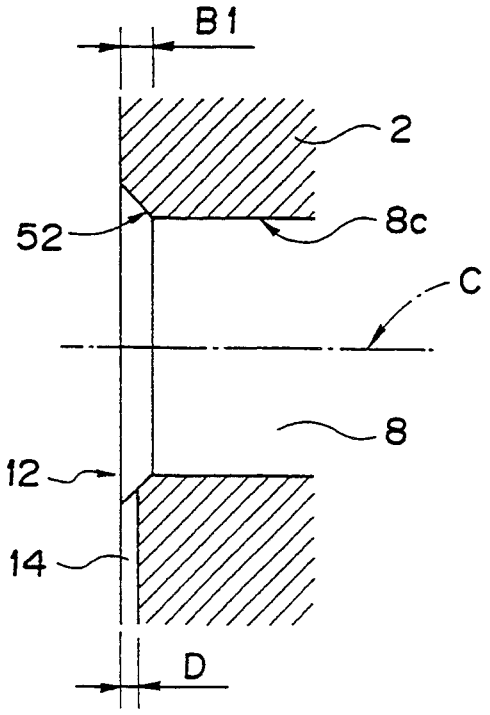
FIG. 4 is an enlarged cross-sectional view illustrating a chamfered portion according to a second embodiment of the invention.
Figure 5:
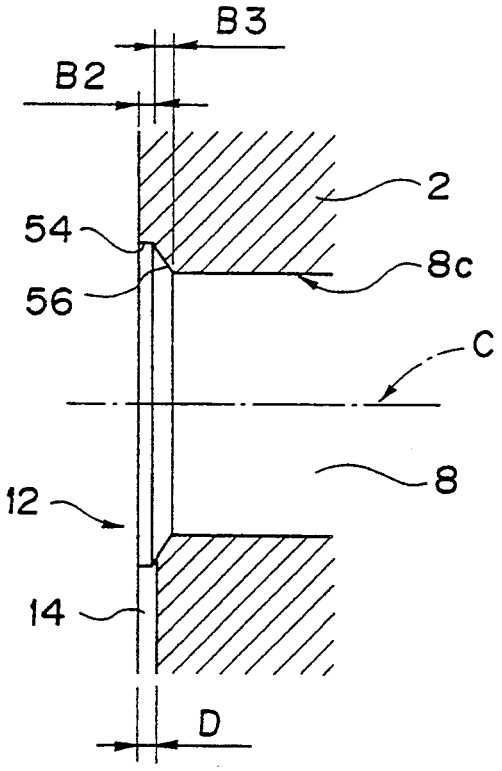
FIG. 5 is an enlarged cross-sectional view depicting another variation in the second embodiment.
Figure 6:
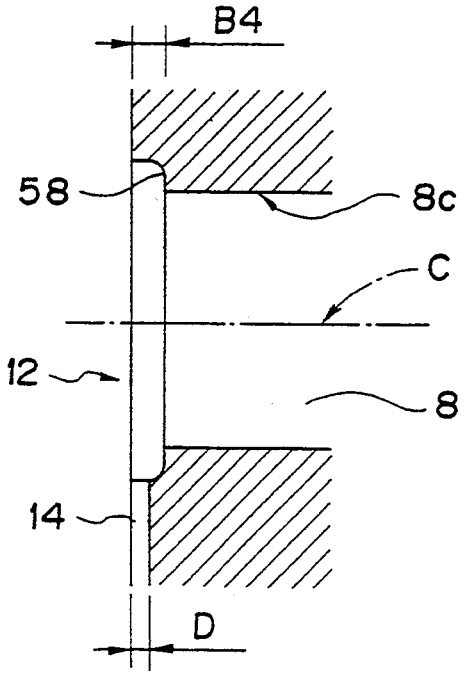
FIG. 6 is an enlarged cross-sectional view illustrating still another variation in the second embodiment.
Figure 7:
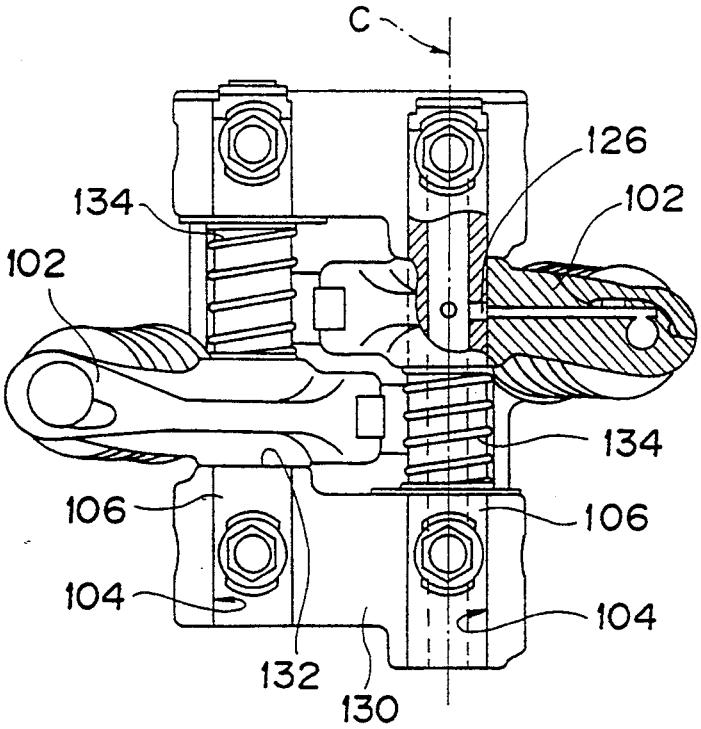
FIG. 7 PRIOR ART
FIG. 7 is a plan view showing a conventional valve-driving mechanism.
Figure 8:
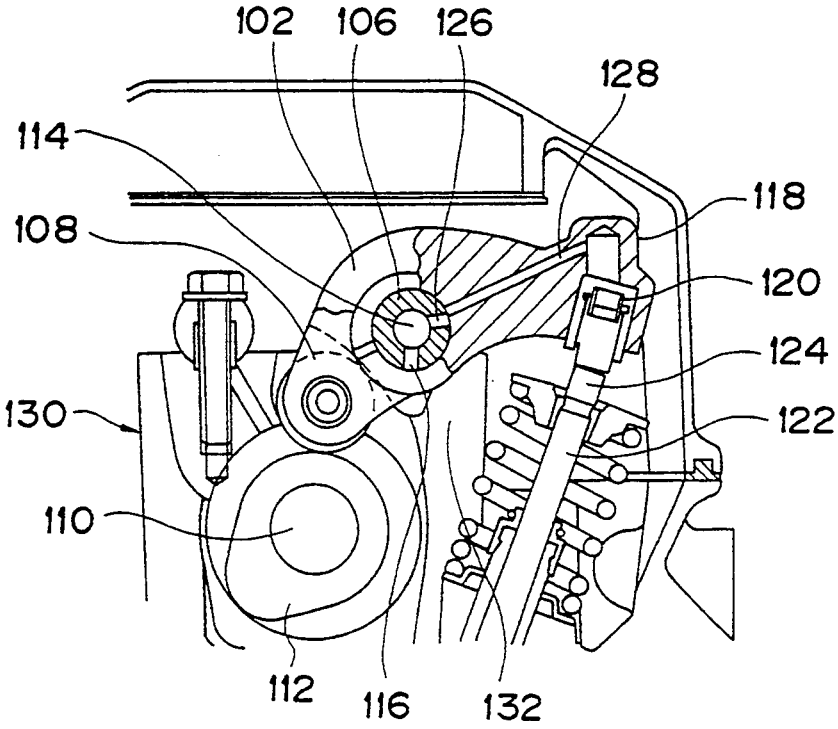
FIG. 8 PRIOR ART
FIG. 8 is a cross-sectional view showing the conventional valve-driving mechanism of FIG. 7.

FIG. 4 through FIG. 6 illustrate a second embodiment of the present invention. For description of this second embodiment, the same reference characters are used for members that serve the same functions as those described in the first embodiment.

The present embodiment is characterized in that a chamfered portion 12, which is formed around the rocker shaft hole 8 in the arm thrust surface 10 of the rocker arm 2, has a depth larger than the depth D of the oil groove 14.

More specifically, as shown in FIG. 4, the arm thrust surface 10 has the chamfered portion 12 extending around the rocker shaft hole 8. The chamfered portion 12 is formed by a beveled surface 52, and has a conical shape. The chamfered portion 12 extends from the arm thrust surface 10 to a depth B1. The depth B1 of the chamfered portion 12 is defined larger than the depth D of the oil groove 14.

As illustrated in FIG. 5, the arm thrust surface 10 has another chamfered portion 12 defined around the rocker shaft hole 8. The chamfered portion 12 is formed by a parallel inner surface 54 and an inwardly beveled surface 56. The parallel inner surface 54 extends to a depth B2 parallel to a shaft axis C. The inwardly beveled surface 56 is arranged in series with the parallel inner surface 54. Further, the inwardly beveled surface 56 slants inwardly to a depth B3. The combined depth for the above two depths B2 and B3 is greater than the depth D of the oil groove 14.

In FIG. 6, the arm thrust surface 10 is shown formed with still another chamfered portion 12. The chamfered portion 12 extends in a perpendicular relationship to the arm thrust surface 10 around the periphery of the rocker shaft hole 8. At the same time, the chamfered portion 12 has a curvilinear surface 58 formed inside the rocker shaft hole 8. The depth B4 of this chamfered portion 12 is greater than the depth D of the oil groove 14.

According to the configuration of this second embodiment, oil flowing between an inner peripheral surface 8*c* of the rocker shaft hole 8 and an outer peripheral surface 16*c* of the rocker shaft 16 is guided into the oil groove 14 through the respective chamfered portions 12 which have greater depths. A smooth flow of oil is thereby provided.

In addition, the chamfered portion 12 can be formed with any rough material shape being maintained, instead of being formed by way of cut-machining. This feature can effect a saving in machining work and its attendant cost.

As apparent from the above-detailed description, according to the present invention, an arm thrust surface of a rocker arm is grooved to provide an oil groove having a predetermined depth, the arm thrust surface being in abutment with a head thrust surface of a cylinder head. The oil groove communicates with a rocker shaft hole so as to introduce oil outside. Accordingly, when oil overflows from a location where the rocker arm is positioned in scraping contact with oil flow communication apertures and a rocker shaft, the oil is blocked from penetrating between the arm thrust surface and the head thrust surface, but is introduced into the oil groove so as to be discharged outside. The rocker arm is thereby prevented from being moved away from the head thrust surface. This feature can avoid the occurrence of pitching of a valve stem end and vibration or noise from a valve-driving system.

Furthermore, since the rocker arm is held in engagement with the head thrust surface, a rocker shaft spring can be set at a lighter load. As a result, low friction is achievable.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rocker arm defined with a rocker shaft hole through which a rocker shaft is inserted, said rocker shaft having an oil passage defined on a shaft axis, said rocker shaft being further formed with an oil flow communication aperture which is radially directed to communicate with said oil passage, an axial position of said rocker arm being determined by a head thrust surface of a cylinder head, the improvement wherein an arm thrust surface of said rocker arm is provided with an oil groove having a predetermined depth, said arm thrust surface being in abutment with said head thrust surface of said cylinder head, said oil groove communicating with said rocker shaft hole so as to introduce oil outside.

2. A rocker arm according to claim 1, wherein said groove extends across said arm thrust surface for communication at one end thereof with said rocker shaft hole and communication at the other end thereof with an outer peripheral surface of the rocker arm.

3. In a rocker arm defined with a rocker shaft hole through which a rocker shaft is inserted, said rocker shaft having an oil passage defined on a shaft axis, said rocker shaft being further formed with an oil flow communication aperture which is radially directed to communicate with said oil passage, an axial position of said rocker arm being determined by a head thrust surface of a cylinder head, the improvement wherein an arm thrust surface of said rocker arm is provided with an oil groove having a predetermined depth, said arm thrust surface being in abutment with said head thrust surface of said cylinder head, said oil groove communicating with said rocker shaft hole so as to introduce oil outside, and said arm thrust surface having a chamfered portion provided around said rocker shaft hole, said chamfered portion being greater in depth than said oil groove.

4. A rocker arm according to claim 3, wherein said groove extends across said arm thrust surface for communication at one end thereof with said rocker shaft hole and communication at the other end thereof with an outer peripheral surface of the rocker arm.

* * * * *